US012605017B2

(12) United States Patent
Teufel et al.

(10) Patent No.: US 12,605,017 B2
(45) Date of Patent: Apr. 21, 2026

(54) PACKAGED CONSUMER PRODUCT WITH PRESERVATIVE GENERATION SYSTEM

(71) Applicant: The Procter & Gamble Company, Cincinnati, OH (US)

(72) Inventors: Amber Grace Teufel, Cincinnati, OH (US); Elizabeth Anne Caserta, Deerfield Township, OH (US); Charles Allen Pettigrew, Jr., West Chester, OH (US); Karolin Katrin Kroening, Lawrenceburg, IN (US); Kelsey Cailtlin Frias, Loveland, OH (US); Michael John Bolander, Loveland, OH (US); Paul Thomas Weisman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 122 days.

(21) Appl. No.: 18/581,433

(22) Filed: Feb. 20, 2024

(65) Prior Publication Data

US 2024/0285132 A1 Aug. 29, 2024

Related U.S. Application Data

(60) Provisional application No. 63/447,674, filed on Feb. 23, 2023.

(51) Int. Cl.

| | |
|---|---|
| ***A47K 10/42*** | (2006.01) |
| ***A47K 10/32*** | (2006.01) |
| ***B65D 81/22*** | (2006.01) |

(52) U.S. Cl.

CPC ..... *A47K 10/421* (2013.01); *B65D 81/22* (2013.01); *A47K 2010/3273* (2013.01)

(58) Field of Classification Search

CPC .. B65D 81/2069; B65D 81/268; B65D 81/22; A47K 2010/3266; A47K 2010/3273; A47K 10/421

(Continued)

(56) References Cited

U.S. PATENT DOCUMENTS 5,126,070 A * 6/1992 Leifheit ..... C11D 17/047 252/186.37

5,650,446 A 7/1997 Wellinghoff et al.

(Continued)

FOREIGN PATENT DOCUMENTS

JP 2005255657 A 9/2005
WO 2017129567 A1 8/2017

OTHER PUBLICATIONS

PCT Search Report and Written Opinion for PCT/US2024/016415 dated Jun. 20, 2024, 11 Pages.

*Primary Examiner* — Chun Hoi Cheung
(74) *Attorney, Agent, or Firm* — Daniel S. Albrecht

(57) ABSTRACT

A packaged consumer product having a first product element, wherein the first product element is a solid-phase material, and a second product element, wherein the second product element is a liquid-phase material, is presented. The packaged consumer product may also have a packaging material defining an interior package space, wherein the first product element and the second product element are disposed within the interior package space. The packaged consumer product may further have a first pouch disposed in the interior package space, wherein the first pouch includes a first semi-permeable material and a reactant disposed within an interior of the first pouch. The reactant is configured to generate chlorine dioxide upon exposure to water and/or water vapor.

20 Claims, 8 Drawing Sheets

(58) Field of Classification Search
USPC ..... 211/45; 206/494, 581
See application file for complete search history.

(56) References Cited

U.S. PATENT DOCUMENTS

| | | | | |
|---|---|---|---|---|
| 6,068,820 | A | 5/2000 | De Guzman | |
| 6,602,466 | B2 | 8/2003 | Hamilton et al. | |
| 6,607,696 | B1 * | 8/2003 | Hamilton | C02F 1/76 422/123 |
| 6,767,509 | B1 * | 7/2004 | Griesbach | B65B 55/18 422/294 |
| 6,827,080 | B2 * | 12/2004 | Fish | A61F 7/03 126/263.01 |
| 7,303,092 | B2 * | 12/2007 | Sarbo | B65D 83/0805 221/49 |
| 7,387,205 | B1 * | 6/2008 | Wilson | B65D 81/268 206/524.4 |
| 7,922,984 | B2 * | 4/2011 | Hamilton | A61L 2/20 206/568 |
| 7,922,986 | B2 | 4/2011 | Byrnard | |
| 8,361,409 | B2 * | 1/2013 | Rico | C01B 11/025 423/462 |
| 10,626,016 | B2 | 4/2020 | Doona et al. | |
| 10,894,656 | B2 * | 1/2021 | Lange | B65D 75/58 |
| 11,179,486 | B2 | 11/2021 | Fukuzaki et al. | |
| 11,358,863 | B2 | 6/2022 | Doona et al. | |
| 11,845,916 | B2 | 12/2023 | Mui | |
| 2002/0070130 | A1 * | 6/2002 | Skoufis | A46B 11/0003 53/469 |
| 2004/0067182 | A1 * | 4/2004 | Kelly | B65D 81/2069 422/305 |
| 2011/0155618 | A1 * | 6/2011 | Rubino | B65D 85/34 206/524.1 |
| 2011/0253562 | A1 * | 10/2011 | Machado | B65B 25/041 53/474 |
| 2012/0097697 | A1 * | 4/2012 | Gehring | B65D 75/5838 221/46 |
| 2012/0241333 | A1 * | 9/2012 | Mueller | B65D 83/0805 53/428 |
| 2013/0071630 | A1 * | 3/2013 | Weisman | D21H 15/10 428/373 |
| 2016/0021888 | A1 * | 1/2016 | Burke | B65D 75/30 424/126 |
| 2019/0002140 | A1 * | 1/2019 | Riley | A23B 2/721 |
| 2019/0003079 | A1 * | 1/2019 | Ashraf | A61F 13/512 |
| 2022/0126254 | A1 * | 4/2022 | Thomas | C01B 11/022 |
| 2022/0226527 | A1 | 7/2022 | Thomas | |

* cited by examiner

PACKAGED CONSUMER PRODUCT WITH PRESERVATIVE GENERATION SYSTEM

CROSS REFERENCE TO RELATED APPLICATION

This application claims the benefit of U.S. Provisional Application No. 63/447,674, filed Feb. 23, 2023, which is incorporated by reference herein in its entirety.

FIELD

The present disclosure is generally directed to packaged consumer products with a preservative generation system. More particularly, the packaged consumer product may include a first product element that is in a solid phase, a second product element that is in a liquid phase, and a preservative generation system designed to preserve the first and second product elements prior to use.

BACKGROUND

Packaged consumer products are often made up of multiple elements which are present in a variety of forms. For example, packaged consumer products such as wet wipes, wet mopping cloths, surface cleansing wipes, and the like, contain both solid-form elements—the cloth/wipe substrate—as well as a liquid-form element—the lotion or cleaning liquid. Such packaged consumer products are made for a variety of uses, including cleaning surfaces, such as household surfaces and the skin of a user.

Packaged consumer products containing a liquid product element typically have a high water activity that may allow for bacterial and mold growth. In order to maintain cleaning efficacy, and because of the intimate contact many packaged consumer products have with their users—such as wet wipes and make-up removal wipes, for example—bacterial and mold growth must be managed in these products. Bacterial and mold growth is typically managed in these types of packaged consumer products by the addition of chemical preservatives to the liquid-form element.

Chemical preservatives can be harsh on surfaces and can irritate the skin of users. It would be desirable to develop a preservative system for packaged consumer products that effectively manages bacteria and mold growth in and/or on the various elements of the packaged consumer product, while transferring very little to no chemical preservatives to the product while in use.

SUMMARY

To solve the problem advanced above, the present disclosure provides, in part, a packaged consumer product comprising a first product element, a second product element, and a preservative generation system. The first product element may be a solid phase material, such as a nonwoven substrate. The second product element may be a liquid phase material, such as a lotion. The first product element and second product element may be fully enclosed by packaging material forming an outer package and disposed within an interior package space. A preservative generation system may be disposed within the interior package space. The preservative generation system may comprise a first pouch comprising a first semi-permeable material and a first reactant. The preservative generation system may generate a preservative when the first reactant is contacted by an activator, such as water and/or water vapor. The preservative may be chlorine dioxide.

The preservative may reduce, inhibit, and/or eliminate bacteria, mold, and/or yeast in both the solid-phase first product element and the second liquid-phase product element. The preservative also leaves behind very little residual chlorate/chlorite species on or in the first product element and the second product element. The packaged consumer product with preservative generation system of the present disclosure may enable a packaged consumer product having both a solid and liquid phase element to remain safe and efficacious over a shelf life without the inclusion of chemical preservatives added to either phase of the product.

BRIEF DESCRIPTION OF THE DRAWINGS

The above-mentioned and other features and advantages of the present disclosure, and the manner of attaining them, will become more apparent and the disclosure itself will be better understood by reference to the following description of example forms of the disclosure taken in conjunction with the accompanying drawings, wherein.

DETAILED DESCRIPTION

Various non-limiting forms of the present disclosure will now be described to provide an overall understanding of the principles of the structure, function, manufacture, and use of the packaged consumer product with preservative generation system disclosed herein. One or more examples of these non-limiting forms are illustrated in the accompanying drawings. Those of ordinary skill in the art will understand that the packaged consumer product with preservative generation system described herein and illustrated in the accompanying drawings are non-limiting example forms. The features illustrated or described in connection with one non-limiting form may be combined with the features of other non-limiting forms. Such modifications and variations are intended to be included within the scope of the present disclosure.

PACKAGING MATERIAL

Figure 1:
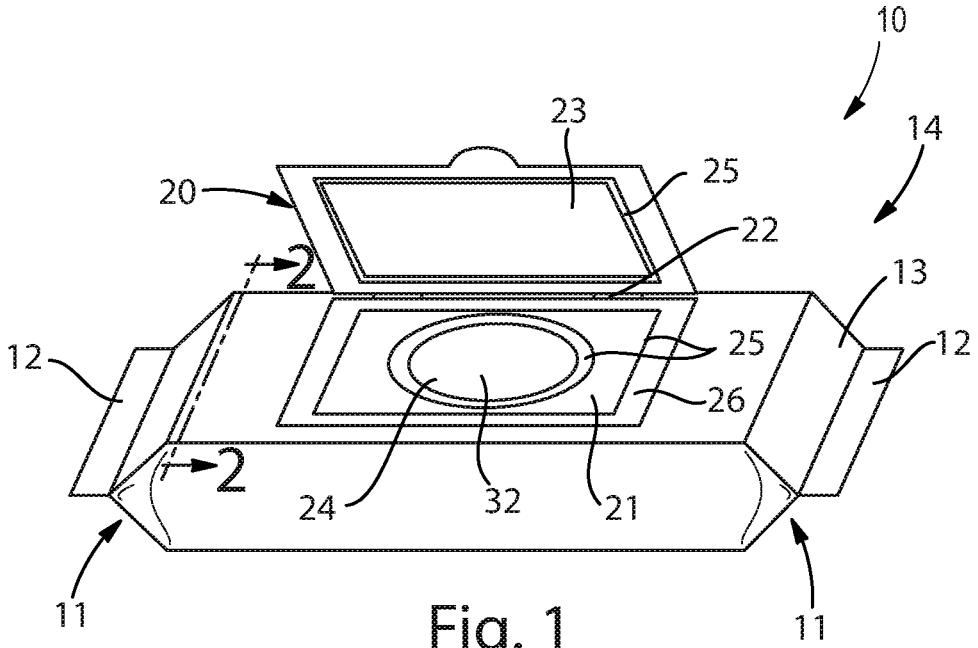
FIG. 1 is a perspective view of a packaged consumer product.
Figure 2:
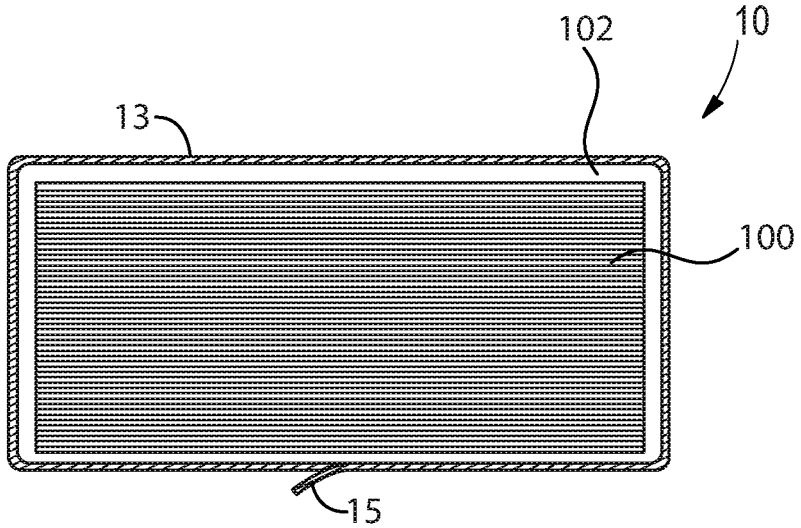
FIG. 2 is a cross-section view of the package of FIG. 1, taken through line 2-2 shown in FIG. 1.

FIGS. 1 and 2 depict a packaged consumer product 10. The packaged consumer product 10 of the present disclosure comprises a packaging material 13 defining an interior package space 102. The packaging material 13 may comprise or consist of polystyrene, polypropylene, PET, POET, polyethylene, polyester, polyvinyl alcohol, or the like. The packaging material 13 may also be made of a mixture of the above materials. The packaging material 13 may form a package 14 in the form of a flexible flow wrap pouch, a rigid tub, or any other suitable configuration.

The packaging material 13 may be formed of a film that is flow-wrapped about a consumer product or plurality of consumer products 100. The selected film material may be unwound from a stock roll and passed in a longitudinal/machine direction into a flow-wrap machine, along with individual consumer products or pluralities of consumer products 100. The flow-wrap machine may be configured so as to wrap the film stock longitudinally about each incoming consumer product or plurality of consumer products 100, join the film along its longitudinal edges to form a sealed fin seam 15 and a sleeve-like structure about the stack, tuck the film at the ends to form tucks 11, and then crimp, seal, and cut the film between each consumer product or plurality of consumer products 100, forming individual packages 14 having end seams 12.

The package 14 may also be provided with an opening feature 20. The opening feature 20 may be a relatively rigid recloseable fitment. The fitment 20 may have a ring portion 21 and a lid 23, connected to the ring portion 21 by a hinge 22. The ring portion 21 may have an opening 24 therethrough to provide access into the interior package space 102, surrounded by an escutcheon portion 26 that is adhered substantially along and about its perimeter to the packaging material 13 so as to provide a substantial moisture-proof seal between the escutcheon and the packaging material. A lid 23 may have an open position and a closed position. One or both of lid 23 and ring portion 21 may be provided with lip, rim, groove, gasket etc. cooperating sealing features 25 such that, when the lid is in the closed position, the cooperating sealing features 25 of lid 23 and/or ring portion 21 are in close proximity or effective contact with the other of lid 23 and/or ring portion 21 about the perimeter of the lid, so as to retard the passage of moisture between the lid 23 and the ring portion 21. One example may be a gasket (not specifically shown) formed of a material that is relatively softer than the material forming the fitment that may be provided about the opening 24 and disposed on either the lid 23 or ring portion 24, to improve the moisture passage retarding function. The fitment including the ring portion 21, hinge 22 and lid 23 may be formed of a polymer such as a polyolefin, for example, polyethylene.

Figure 3:
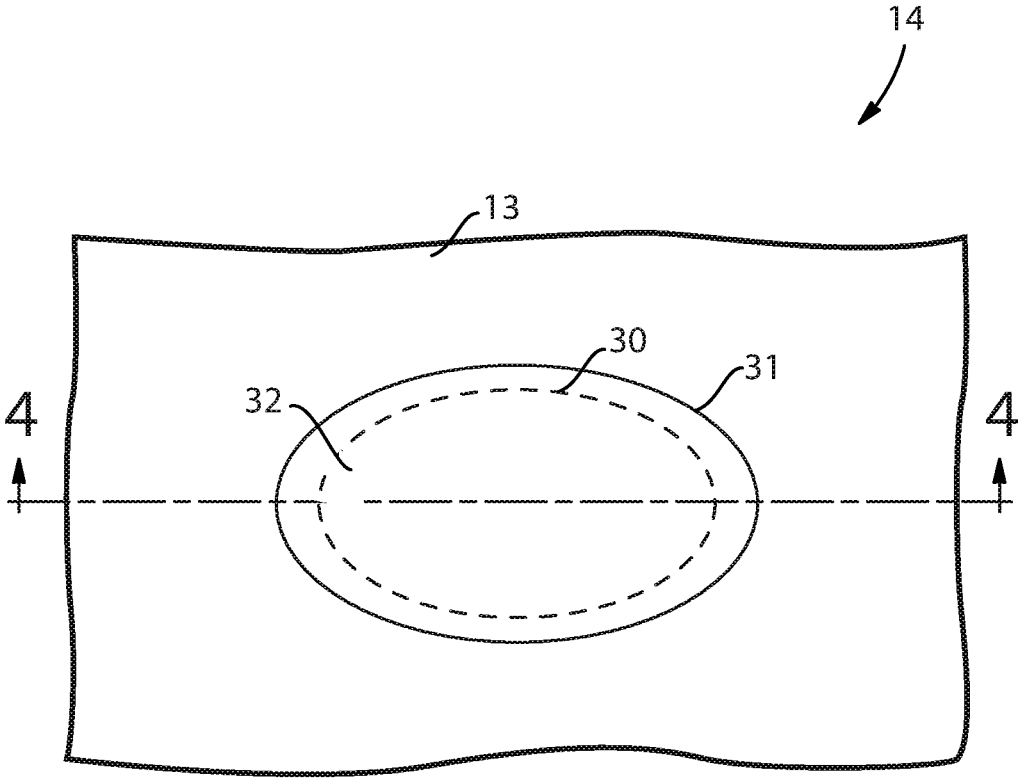
FIG. 3 is a plan view of a portion of a package face with an outline of perforations covered by an opening feature flexible film.
Figure 4:
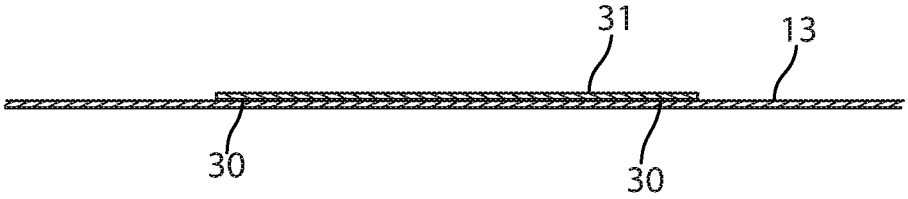
FIG. 4 is a cross section view of the portion of the package face of FIG. 3, taken through line 4-4 shown in FIG. 3.

Referring to FIGS. 1 and 3, a fitment opening 24 may frame a package access opening 32 defined in the packaging material 13. Perforations 30 may outline a closed shape of the package access opening 32 through the packaging material 13. The perforations 30 are typically formed by a perforating die, and typically completely penetrate the packaging material. An opening feature flexible film 31 may be disposed on the packaging material 13 and over the package access opening 32, that is of sufficient size to cover the entire package access opening 32 and/or all of the perforations 30 and thereby obstruct the passage of moisture therethrough. The opening feature flexible film may be in the form of an adhesive-backed film sticker, wherein the adhesive-backed side of the film sticker is removably adhered to a portion of the packaging material 13.

First Product Element

Figure 5:
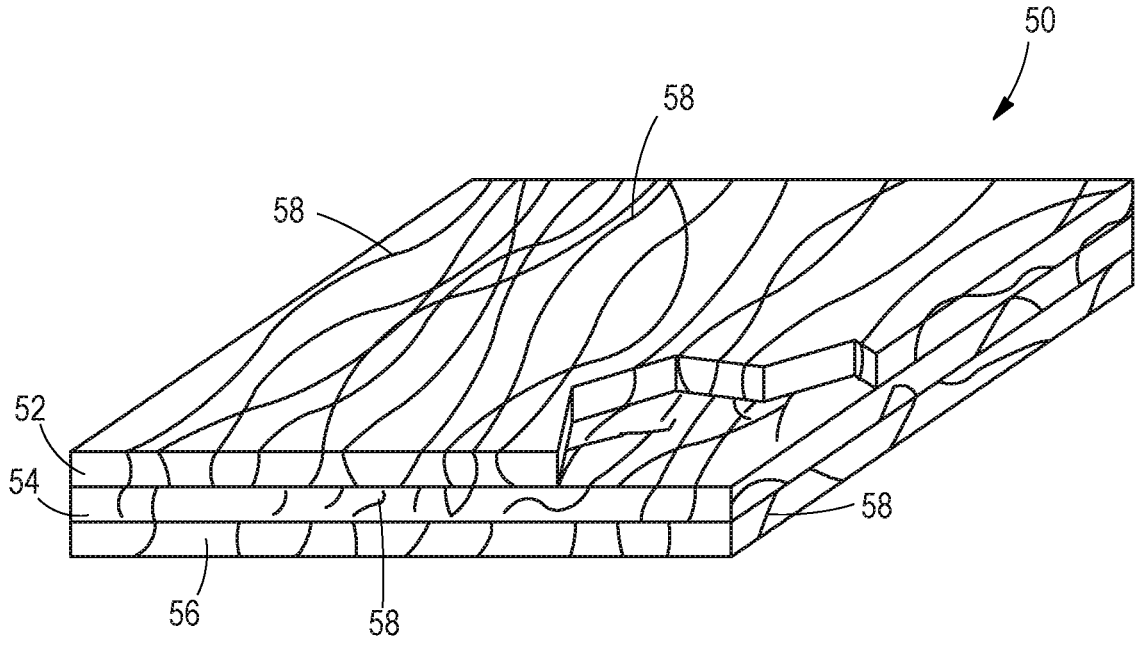
FIG. 5 is a schematic illustration of a wet wipe substrate having multiple layers.

The packaged consumer product of the present disclosure may comprise a first product element, wherein the first product element is a solid phase material. The solid phase material may be a substrate formed from a web of fibers. The substrate may be homogenous or may be layered. If layered, the substrate may comprise at least two, at least three, at least four, or at least five layers. Referring to FIG. 5, the substrate 50 may be formed of one layer 52 of a web of fibers 58. The substrate 50 may be formed of more than one layer of webs of fibers 58. For example, the substrate 50 may be formed of a first layer 52 of a web of fibers 58, a second layer 54 of a web of fibers 58, and a third layer 56 of a web of fibers 58. The one or more layers of webs of fibers may comprise a nonwoven web of materials comprising continuous fibers, coextruded fibers, non-continuous fibers, and/or combinations thereof. Nonwoven web materials may comprise cellulosic fibers, modified cellulosic fibers, synthetic fibers, mixtures of cellulosic and/or modified cellulosic fibers with synthetic fibers, and/or combinations thereof. The fibers comprising the nonwoven web materials may be processed to be suitably soft-feeling against the skin.

The nonwoven web materials may comprise, consist essentially of, or consist entirely of cellulosic fibers. Non-limiting examples of cellulosic fibers include wood pulp, typical northern softwood Kraft, typical southern softwood Kraft, typical CTMP, typical deinked, corn pulp, acacia, eucalyptus, aspen, reed pulp, birch, maple, radiata pine, albardine, esparto, wheat, rice, corn, sugar cane, papyrus, jute, reed, sabia, raphia, bamboo, sidal, kenaf, abaca, cotton, flax, hemp, jute, modified natural cellulosic fibers such as, for example, rayon (including viscose, lyocell, MODAL (a product of Lenzing AG, Lenzing, Austria) and cuprammonium rayon), and combinations thereof. Cellulosic fibers may be consumer-preferred to appeal to a desire for natural and/or environmentally friendly products. The cellulosic fibers may be treated or otherwise modified mechanically and/or chemically to provide desired characteristics, or may be in a form that is generally similar to the form in which they may be found in nature. Mechanical and/or chemical manipulation of natural fibers does not exclude them from what are considered natural fibers with respect to the present disclosure.

The nonwoven web materials may comprise, consist essentially of, or consist entirely of synthetic fibers. Non-limiting examples of synthetic fibers include polyesters (e.g., polyethylene terephthalate), polyolefins, polypropylenes, polyethylenes, polyethers, polyamides, polyesteramides, polyvinylalcohols, polyhydroxyalkanoates, polysaccharides, and combinations thereof. The polyester may comprise less than 100 ppm antimony, or the polyester may be devoid of antimony. Further, the synthetic fibers may be a single component (i.e., single synthetic material or mixture makes up entire fiber), bi-component (i.e., the fiber is divided into regions, the regions including two or more different synthetic materials or mixtures thereof and may include coextruded fibers and core and sheath fibers) and combinations thereof. Bi-component fibers may be used as a component fiber of the structure, and/or they may be present to act as a binder for the other fibers present in the fibrous structure. Any or all of the synthetic fibers may be treated before, during, or after manufacture to change any desired properties of the fibers. The substrate may comprise hydrophilic fibers, hydrophobic fibers, or a combination thereof.

The wet wipe substrate may comprise between about 30% and about 100%, between about 50% and about 100%, or between about 65% and 100%, by weight of the substrate of cellulosic fibers, specifically reciting each 1% increment within these ranges and every range formed therein or thereby. The substrate may comprise about 50% cellulosic fibers and about 50% synthetic fibers, by weight of the substrate. The substrate may comprise about 30% cellulosic fibers and about 70% synthetic fibers, by weight of the substrate. The substrate may comprise about 100% cellulosic fibers, such as a mixture of about 50% viscose and about 50% lyocell, by weight of the substrate. The substrate may comprise about 100% cellulosic fibers, such as a mixture of about 85% lyocell and about 15% cotton, by weight of the substrate. The substrate may comprise about 100% cellulosic fibers, wherein the cellulosic fibers comprise between about 10% to about 70% viscose, by weight of the substrate. The substrate may be devoid of polyesters, polyamides, and/or polyolefins.

It may be desirable that the substrate, or at least one or more layers of the substrate, comprises a particular combinations of fibers to provide desired characteristics. For example, it may be desirable to have fibers of certain lengths, widths, coarseness, or other characteristics combined in certain layers, or separate from each other in distinct layers. The fibers may be of virtually any size and may have an average length from about 1 mm to about 60 mm, specifically reciting each 1 mm increment within the range and every range formed therein. Average fiber length refers to the length of the individual fibers if straightened out. The fibers may have an average fiber width of greater than about 5 micrometers. The fibers may have an average fiber width of from about 5 micrometers to about 50 micrometers, specifically reciting each 1 micrometer increment within the range and every range formed therein. The fibers may have a coarseness of greater than about 5 mg/100 m. The fibers may have a coarseness of from about 5 mg/100 m to about 75 mg/100 m, specifically reciting each 1 mg/100 m increment within the range and every range formed therein.

The fibers may be circular in cross-section, dog-bone shape, delta (i.e., triangular cross section), trilobal, ribbon, or other shapes typically produced as staple fibers. Likewise, the fibers may be conjugate fibers such as bicomponent fibers. The fibers may be crimped and may have a finish, such as a lubricant, applied.

The materials comprising the substrate may be treated to improve the softness and texture thereof. The substrate may be subjected to various treatments, such as physical treatment, hydro-molding, hydro-embossing, hydro-entangling, ring rolling, as described in U.S. Pat. No. 5,143,679; structural elongation, as described in U.S. Pat. No. 5,518,801; consolidation, as described in U.S. Pat. Nos. 5,914,084; 6,114,263; 6,129,801 and 6,383,431; stretch aperturing, as described in U.S. Pat. Nos. 5,628,097; 5,658,639; and 5,916,661; differential elongation, as described in U.S. Pat. No. 7,037,569, other solid state formation technologies as described in U.S. Pat. Nos. 7,553,532 and 7,410,683; zone activation, and the like; chemical treatment, such as rendering part or all of the substrate hydrophobic and/or hydrophilic, and the like; thermal treatment, such as thermal-embossing, softening of fibers by heating, thermal bonding and the like; and combinations thereof.

Figure 6:
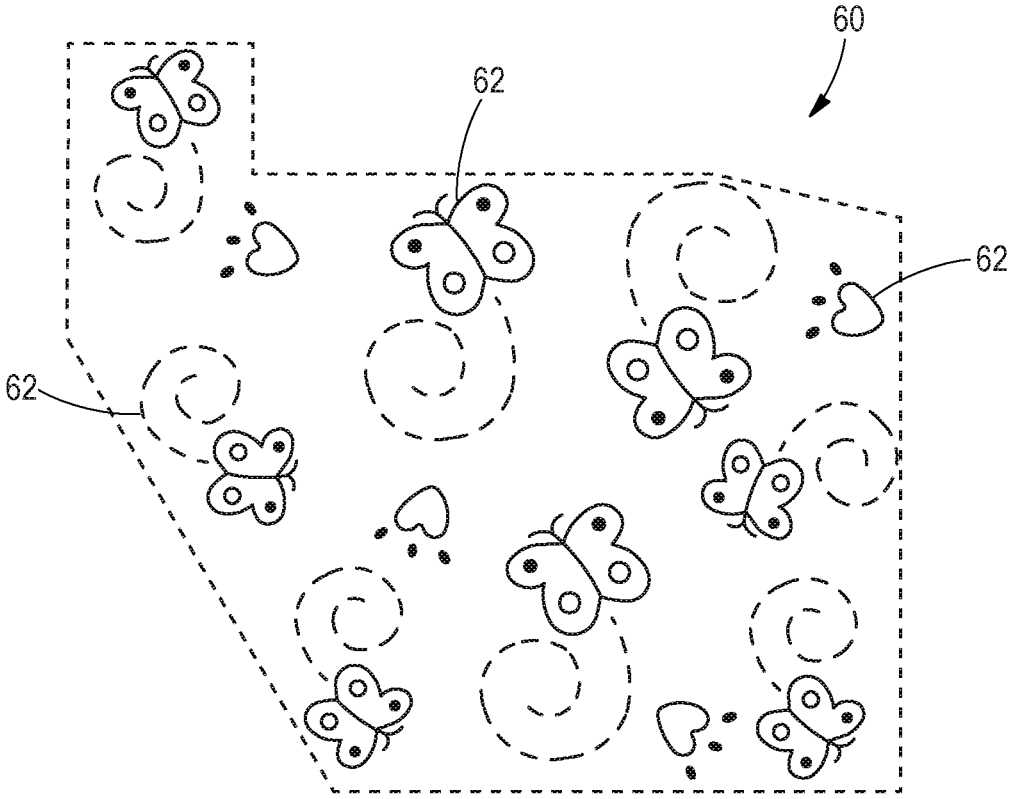
FIG. 6 is a schematic illustration of a wet wipe substrate comprising a plurality of texture elements that form a pattern.

Without wishing to be bound by theory, it is believed that a textured substrate may further enable the ease of removal of soils by improving the ability to grip or otherwise lift the soils from the surface during cleansing. Any one of a number of texture elements may be useful in improving the ability to grip or otherwise lift the soil from the surface during cleansing, such as continuous hydro-molded elements, hollow molded element, solid molded elements, circles, squares, rectangles, ovals, ellipses, irregular circles, swirls, curly cues, cross hatches, pebbles, lined circles, linked irregular circles, half circles, wavy lines, bubble lines, puzzles, leaves, outlined leaves, plates, connected circles, changing curves, dots, honeycombs, and the like, and combinations thereof. The texture elements may be hollow elements. The texture elements may be connected to each other. The texture elements may overlap each other. The texture elements may form a pattern. Referring to FIG. 6, the substrate 60 may comprise a plurality of texture elements 62 that form a pattern in and/or on the substrate 60.

The substrate may have a basis weight between about 15 grams/$m^2$ (gsm) and about 100 gsm, between about 30 gsm and about 95 gsm, between about 40 gsm and about 85 gsm, between about 45 gsm and about 75 gsm, or between about 52 gsm and about 65 gsm, specifically reciting every 1 gsm increment within the ranges and every range formed therein or thereby. Exemplary nonwoven substrates are described in U.S. Patent Application Publication 2012/066852 and U.S. Patent Application Publication 2011/244199.

The surface of the substrate may be essentially flat. The surface of the substrate may optionally contain raised and/or lowered portions. The raised and/or lowered portions may be in the form of logos, indicia, trademarks, geometric patterns, and/or images of the surfaces that the substrate is intended to clean (i.e., infant's body, face, etc.). The raised and/or lowered portions may be randomly arranged on the surface of the substrate or be in a repetitive pattern.

The substrate may be biodegradable. For example, the substrate may comprise a biodegradable material such as a polyesteramide or a high wet strength cellulose. The substrate may be dispersible in water. The substrate may be dispersible in water with moderate agitation, such as the agitation achieved during the flush cycle of a typical toilet.

The substrates described herein may have different properties on different sides of the substrate. For example, one side of the substrate may have good cleaning performance and the other side of the substrate may have good tactile sensation to the user. In another form, one side of the substrate may have an increased cleaning performance as compared to the other side of the substrate.

Non-limiting examples of processes for making webs of fibers of the substrate described herein include known wet-laid papermaking processes, air-laid papermaking processes including carded and/or spunlaced processes. Such processes typically include steps of preparing a fiber composition in the form of a suspension in a medium, either wet, more specifically aqueous medium, or dry, more specifically gaseous, i.e., with air as a medium. The aqueous medium used for wet-laid processes is oftentimes referred to as a fiber slurry. The fibrous slurry is then used to deposit a plurality of fibers onto a forming wire or belt such that an embryonic web of fibers is formed, after which drying and/or bonding the fibers together results in a web of fibers. Further processing the web of fibers may be carried out such that a finished web of fibers is formed. For example, in typical papermaking processes, the finished web of fibers is the fibrous structure that is wound on the reel at the end of papermaking, and may subsequently be converted into a finished product, e.g., a wet wipe substrate.

The web of fibers of the substrates described herein may be a co-formed fibrous structure. "Co-formed fibrous structure," as used herein, means that the fibrous structure comprises a mixture of at least two different materials, wherein at least one of the materials comprises a filament, such as a polypropylene filament, and at least one other material different from the first material, comprises a solid additive, such as a fiber and/or a particulate. In one example, a co-formed fibrous structure comprises solid additives—such as fibers (for example, wood pulp fibers) and/or absorbent gel materials and/or filler particles and/or particulate spot bonding powders and/or clays—and filaments—such as polypropylene filaments. "Solid additive" as used herein means a fiber and/or a particulate. "Particulate" as used herein means a granular substance or powder. "Fiber" and/or "Filament" as used herein means an elongate particulate having an apparent length greatly exceeding its apparent width, i.e., a length to diameter ratio of at least about 10. For purposes of the present disclosure, a "fiber" is an elongate particulate as described above that exhibits a length of less than 5.08 cm (2 in.) and a "filament" is an elongate particulate as described above that exhibits a length of greater than or equal to 5.08 cm (2 in.).

Figure 7:
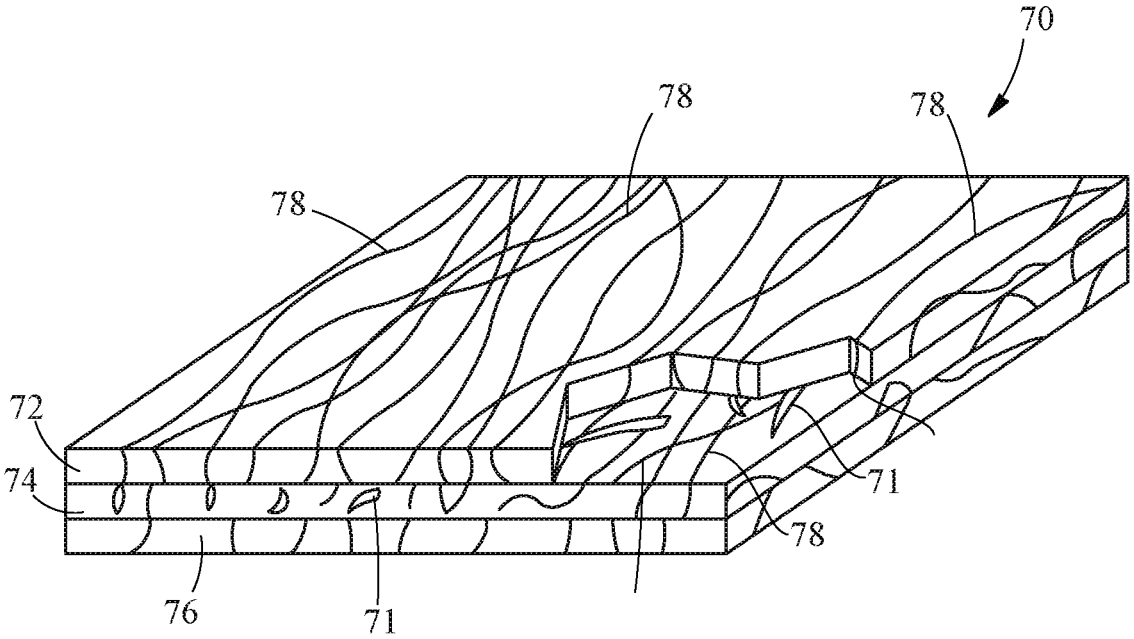
FIG. 7 is a schematic illustration of a co-formed wet wipe substrate.

Referring to FIG. 7, the substrate 70 may be a co-formed layered fibrous structure. The co-formed layered fibrous structure may comprise a first layer 74 comprising a plurality of filaments 78, such as polypropylene filaments, and a plurality of solid additives 71, such as wood pulp fibers, for example. The co-formed layered fibrous substrate 70 may further comprise a second layer 72 and a third layer 76, each comprising a plurality of filaments 78, such as polypropylene filaments, for example. The first layer 74 may be disposed between the second layer 72 and the third layer 76. In a form, the first layer 74, second layer 72, and third layer 76 may be sharply defined zones of concentration of the filaments 78 and/or solid additives 71. The plurality of filaments 78 of the second layer 72 and third layer 76 may be deposited directly onto a surface of the first layer 74 to form the co-formed layered fibrous structure. In another form, the first layer may form an outward-facing surface of the substrate and may be in direct contact with only one other layer.

The substrate described herein may be subjected to any post-processing operations such as embossing operations, printing operations, tuft-generating operations, thermal bonding operations, ultrasonic bonding operations, perforating operations, surface treatment operations such as application of lotions, silicones and/or other materials, folding, and/or combinations thereof.

Second Product Element

The packaged consumer product of the present disclosure may comprise a second product element, wherein the second product element is a liquid phase material. The second product element, otherwise referred to herein as a lotion, may comprise various chemical constituents that carry out functions such as cleaning and buffering, as will be discussed in detail herein. The second product element, or lotion, may comprise from about 96% water to about 100% water, from about 97.5% water to about 100% water, or from about 98.2% water to about 100% water, by weight of the lotion, specifically reciting every 0.1% increment within these ranges and any ranges formed therein or thereby, according to the Water Content Method disclosed herein. A lotion comprising water within the above-specified ranges may be gentle on the skin, especially when the packaged consumer product is employed to cleanse delicate areas of the body.

The lotions of the present disclosure may comprise a pH buffering system. The pH buffering system may be present at from about 0.1% to about 1%, from about 0.25% to about 1%, from about 0.375% to about 0.85%, or from about 0.45% to about 0.75%, by weight of the lotion, specifically reciting every 0.01% increment within these ranges and any ranges formed therein or thereby. The pH buffering system may be a citrate-citric acid buffering system at a pH of less than 5. The pH buffering system may be a citrate-citric acid buffering system at a pH of less than 4. The pH buffering system may be a sodium citrate-citric acid buffering system at a pH of less than 5. The pH buffering system may be a sodium citrate-citric acid buffering system at a pH of less than 4. The pH buffering system may comprise sodium citrate dihydrate and citric acid anhydrous. The lotions of the present disclosure may have a pH from about 3.4 to about 6, from about 3.5 to about 5, from about 3.6 to about 4.8, from about 3.6 to about 4.4, from about 3.6 to about 4.2, or from about 3.8 to about 4.2, specifically reciting every 0.1% increment within these ranges and any ranges formed therein or thereby.

The Equivalence Value of a lotion may be an indication of the lotion's resistance to an increase in pH. A lotion having a higher Equivalence Value may be desired in the context of a wet wipe because it may help to protect a baby's skin against irritation caused by feces and urine residue that remains after cleaning. The proteases in feces that may damage the skin can start to become active around pH 5 and can reach peak activity between pH 7 to 8. Urea in urine may be converted to ammonia by bacteria on the skin, elevating the pH and making the fecal proteases more active. By depositing a lotion with a higher Equivalence Value on the skin, an acidic buffer may be created that resists the rise in pH that may otherwise occur over time and/or when trace amounts of feces and urine are present. By resisting the rise in pH, a lotion with a higher Equivalence Value may protect the skin from damage caused by fecal proteases and reduce the likelihood that rash will occur between diaper changes. The lotions of the present disclosure may have an Equivalence Value from about 25 to about 100, from about 30 to about 95, from about 55 to about 90, from about 65 to about 90, from about 60 to about 80, from about 62 to about 75, or from about 65 to about 70, specifically reciting every 1.0 unit increment within these ranges and any ranges formed therein or thereby, according to the Buffering Capacity Test Method described herein.

The second product element may be devoid, or free, of chemical preservatives. Chemical preservatives include benzoic acid and/or a salt thereof, succinic acid and/or a salt thereof, phytic acid and/or a salt thereof, and combinations thereof. It is believed that a second product element, such as a lotion, that is devoid of chemical preservatives may exhibit a low sting potential due to the absence of the chemical preservatives. Lotions that exhibit a low sting potential are consumer preferred because they are often experienced as being more soothing, especially to delicate and sensitive skin.

The second product element may be disposed within the interior package space in an amount of between about 1.0 g and about 8.0 g per gram of the first product element.

In a form, the second product element may be disposed within the interior package space of the packaged consumer product upon initial manufacture of the packaged consumer product. In other words, the manufacturer of the packaged consumer product may combine the first product element and the second product element within the interior package space prior to sealing the package.

In another form, the packaged consumer product may be manufactured and sold devoid of the second product element. The second product element may be added by a consumer to a package containing the first product element. Upon addition of the second product element by a consumer, for example, the resulting packaged consumer product containing a first product element and a second product element falls within the packaged consumer product contemplated by this disclosure.

Preservative Generation System

The packaged consumer product of the present disclosure comprises a preservative generation system. The preservative generation system may be enclosed by the packaging material and disposed within the interior package space. The preservative generation system is configured to generate a preservative within the interior package space. The preservative may preserve, or assist in the preservation of, the first product element, the second product element, and/or the packaged consumer product as a whole. Exemplary preservative generation systems are described in U.S. Pat. Nos. 6,607,696; 6,602,466; and 7,922,984, each of which is herein incorporated by reference.

Figure 8:
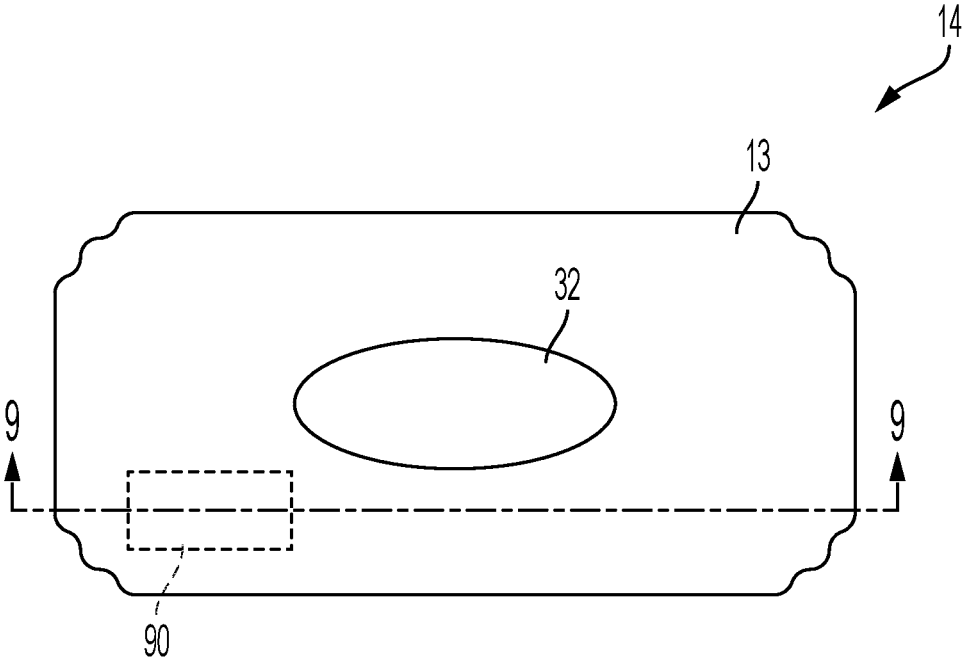
FIG. 8 is a plan view of a portion of a package illustrating placement of a preservative generation system within the package.
Figure 9:
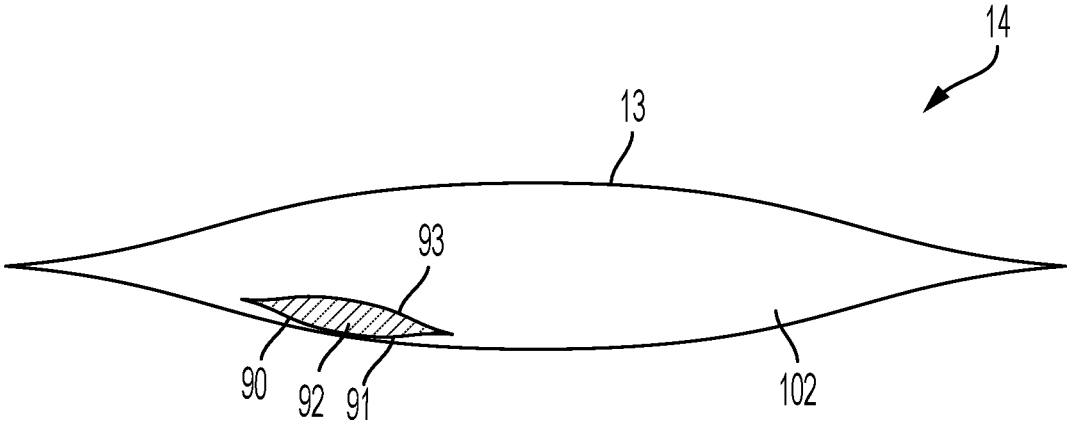
FIG. 9 is a cross section view of the portion of the package of FIG. 8, taken through line 9-9 shown in FIG. 8.
Figure 10:
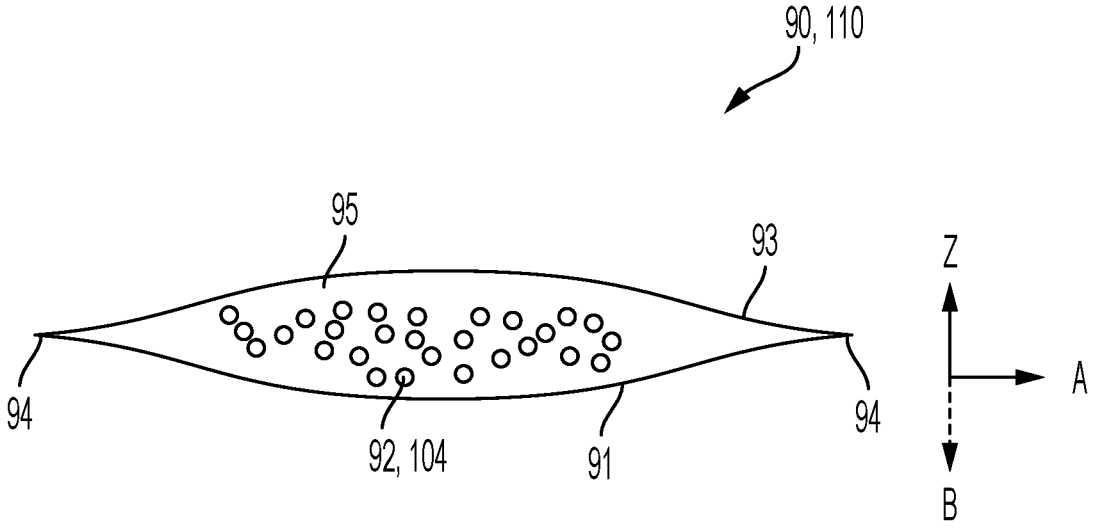
FIG. 10 is a cross section view of a first pouch and/or a second pouch of a preservative generation system.

Referring now to FIGS. 8-10, the preservative generation system may comprise a first pouch 90. The first pouch 90 may define a closed receptacle around a reactant 92, discussed in further detail below. The first pouch 90 may comprise a first semi-permeable material. The first semi-permeable material may be designed and/or configured to allow entry of water and/or water vapor into the first pouch 90. The first semi-permeable material may be designed and/or configured to allow egress of a preservative, for example a preservative gas. The first semi-permeable material may comprise or be formed of perforated films, non-perforated films, and/or selective transmission films, and combinations thereof.

The first pouch 90 comprising or formed of a perforated film may have a water vapor transmission rate (WVTR) between about 50 $g/m^2/24$ hours and about 1,000 $g/m^2/24$ hours, between about 200 $g/m^2/24$ hours and about 800 $g/m^2/24$ hours, or between about 400 $g/m^2/24$ hours and about 700 $g/m^2/24$ hours, specifically reciting every 1 $g/m^2/24$ hours increment within these ranges and any ranges formed therein or thereby. The perforated film may be hydrophobic. Perforated films suitable for the construction of the envelope may include, but are not limited to, polymeric material, e.g., Cryovac® perforated films available from Sealed Air Corporation (Duncan, S.C.). One such film is a hydrophobic polypropylene copolymer film sold under the designation SM700 by Sealed Air Corporation and has 330 holes per square inch having a diameter of 0.4 mm, a 6.4% perforated area, a thickness of about 20 microns, and a water vapor transmission rate of 700 g/m 2/24 hrs. Another suitable film is a hydrophobic polypropylene copolymer film sold under the designation SM60 by Sealed Air Corporation and has 8 holes per square inch having a diameter of 0.4 mm, a 0.2% perforated area and a water vapor transmission rate of 65 g/m 2/24 hrs.

The first pouch 90 may comprise or be formed of hydrophobic, liquid water permeable material, such as polyethylene or polypropylene. These materials preferably are between about 1 mil (0.0254 mm) and about 10 mils (0.254 mm) thick with a water intrusion pressure of about 30 millibars or 30 millibars or less. Hydrophobic materials may include, but are not limited to, non-woven polyethylene such as the TYVEK® non-woven polyethylenes from DuPont Company (Wilmington, Del.), e.g., the TYVEK® 1025D non-woven polyethylene which has an intrusion pressure of less than 30 millibars.

The first pouch 90 may comprise, or be formed from, a hydrophilic membrane having a pore size between about 0.01 μm and about 50 μm, between about 0.05 μm and 40 μm, or between about 0.1 μm and about 30 μm. The membrane may be the microporous ultra high density polyethylene membrane sold under the trade designation MPLC from Millipore (Bedford, Mass.), and the microporous Nylon 6,6 membrane sold under the designation 045ZY by Cuno Incorporated (Meriden, Conn.).

Selective transmission films are films that are neither perforated nor porous, but instead transfer gases through the polymer structure of the film. Selective transmission films are multilayered or mixed polymer materials, where the layers and the polymers are chosen for controlled transmission of gases such as carbon dioxide and oxygen. Selective transmission films may be beneficial in dry applications because they allow gas to diffuse out of the first pouch, while retaining an initiating agent and reactant. Moreover, the selective transmission film may increase the stability of the preservative generation system prior to its use because it does not easily allow ambient water and/or water vapor to diffuse into the first pouch, which could prematurely initiate reactants.

The first pouch 90 comprises a reactant 92 disposed within an interior of the first pouch, wherein the reactant is configured to generate a preservative upon exposure to water and/or water vapor. The reactant 92 may be a compound or a mixture of compounds configured to generate the preservative. The preservative may be in a gas phase. Generation of a gas, e.g., by acid activation, is well known in the art. For example, chlorine dioxide ($ClO_2$) may be generated from sodium chlorite and an acid, such as citric acid, in the presence of moisture. Alternatively, chlorine dioxide can be produced by the reduction of a chlorate, e.g., sodium chlorate or potassium chlorate, in the presence of an acid, e.g., oxalic acid. The reactant may comprise at least one of: sodium chlorite, potassium chlorite, citric acid, and combinations thereof.

Referring to FIG. 10, the first pouch 90 may comprise a first side 91 and a second side 93. The first side 91 and the second side 93 may each be formed by separate pieces of material which are attached at pouch seams 94. The first side 91 of the first pouch 90 may be joined and/or bonded to the packaging material 13. The first side 91 of the first pouch 90 may be adhesively joined to the packaging material 13. At least a portion of the second side 93 of the first pouch 90 may be free of attachment to the packaging material 13. The second side 93 of the first pouch 90 may comprise or be formed from the semi-permeable material. The first pouch 90 may be sealed such that the reactant 92 is disposed only in the interior 95 of the first pouch 90. The first pouch 90 may be configured to allow the ingress of water and/or water vapor. The first pouch 90 may be configured to allow the egress of the preservative, while maintaining the reactant 92 within the interior 95 of the first pouch 90. Ingress of water and/or water vapor and egress of the preservative may be through the semi-permeable material. The preservative may be chlorine dioxide gas.

Individual packages of the packaged consumer product 10 may be formed by sealing the first product element, second product element, and preservative generation system within the interior package space 102 formed by the packaging material 13. Alternatively, the second product element may be added to a package containing the first product element, for example by a consumer, to form the packaged consumer product of the present disclosure. The preservative generation system, and more specifically the first pouch 90, may come into contact with water and/or water vapor upon assembly of the packaged consumer product 10, either by a manufacturer or a consumer, where the preservative generation system comes into contact with the liquid phase second product element, which may be a lotion. The water and/or water vapor from the second product element may cross the semi-permeable material of the first pouch 90, which may form at least a portion of the second side 93 of the first pouch 90, during or shortly after assembly of the packaged consumer product 10 and may come into contact with the reactant 92, initiating a preservative generation reaction with the reactant 92. The reaction may form a preservative or preservatives. The preservative or preservatives may be in the form of a gas. The preservative may permeate the semi-permeable material and enter the interior package space 102. The packaging material 13 defining and surrounding the interior package space 102 may be impermeable to the preservative(s), and may hold the preservative(s) within the interior package space 102 until the package is opened.

The preservative may be contained within the interior package space 102 and may be present in a sufficient amount to reduce, inhibit, and/or eliminate bacteria, yeast, and/or mold in and/or on consumer product elements within the interior package space 102 while the package is sealed (prior to opening). The preservative may be chlorine dioxide. The interior package space 102 of a sealed package may comprise a gaseous phase. The gaseous phase may comprise between about 0.25 ppm and about 5 ppm chlorine dioxide, between about 0.3 ppm and about 4.5 ppm chlorine dioxide, between about 0.35 ppm and about 3.75 ppm chlorine dioxide, or between about 0.45 and about 4.25 ppm chlorine dioxide, specifically reciting ever 0.01 ppm increment within these ranges and any ranges formed therein or thereby.

The inventors have found that the level of chlorine dioxide generated by the preservative generation system is capable of reducing, inhibiting, and/or eliminating bacteria, mold, and/or yeast while leaving very little residual chlorate/chlorite species on and/or in either the first product element or the second product element. When tested upon opening of the packaged consumer product 10 of the present disclosure, the first product element may comprise less than 1000 μg/ml chlorate and/or chlorite species, less than 800 μg/ml chlorate and/or chlorite species, less than 650 μg/ml chlorate and/or chlorite species, less than 500 μg/ml chlorate and/or chlorite species, or less than 375 μg/ml chlorate and/or chlorite species. When tested upon opening of the packaged consumer product 10 of the present disclosure, the second product element may comprise less than 1000 μg/ml chlorate and/or chlorite species, less than 800 μg/ml chlorate and/or chlorite species, less than 650 μg/ml chlorate and/or chlorite species, less than 500 μg/ml chlorate and/or chlorite species, or less than 375 μg/ml chlorate and/or chlorite species.

Figure 11:
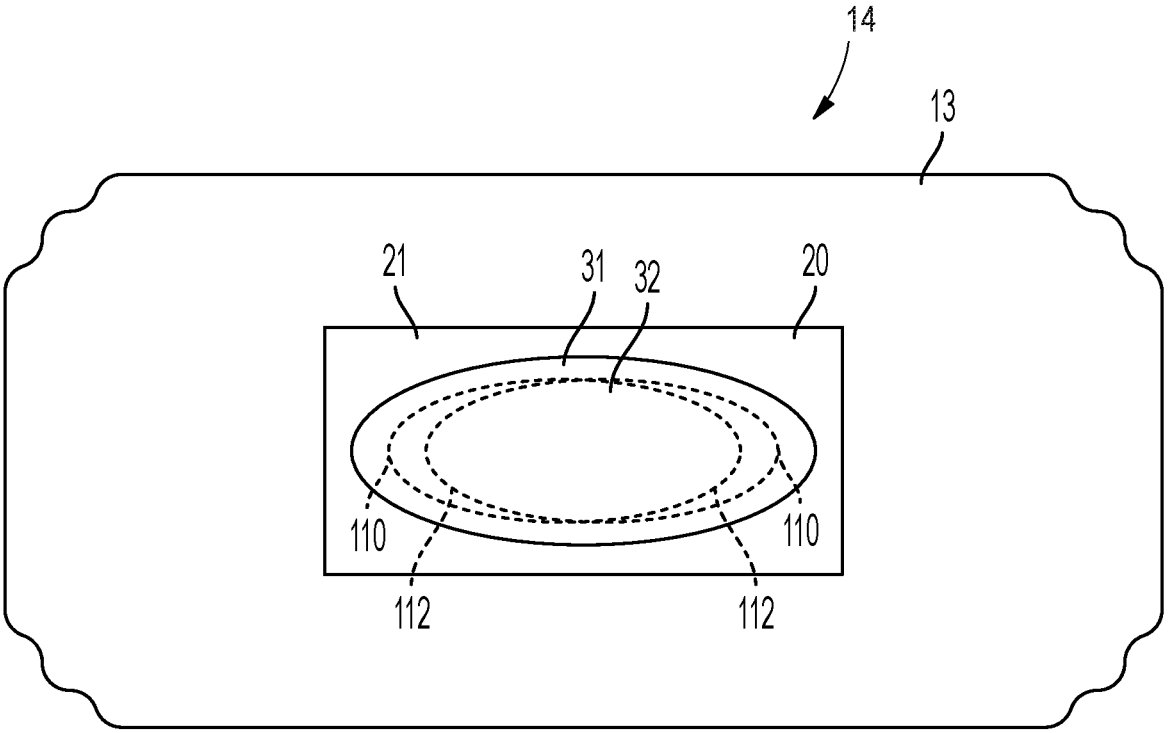
FIG. 11 is a plan view of a portion of a package face with a second semi-permeable membrane of a second pouch of a preservative generation system covered by an opening feature flexible film in a first, unopened configuration.
Figure 12:
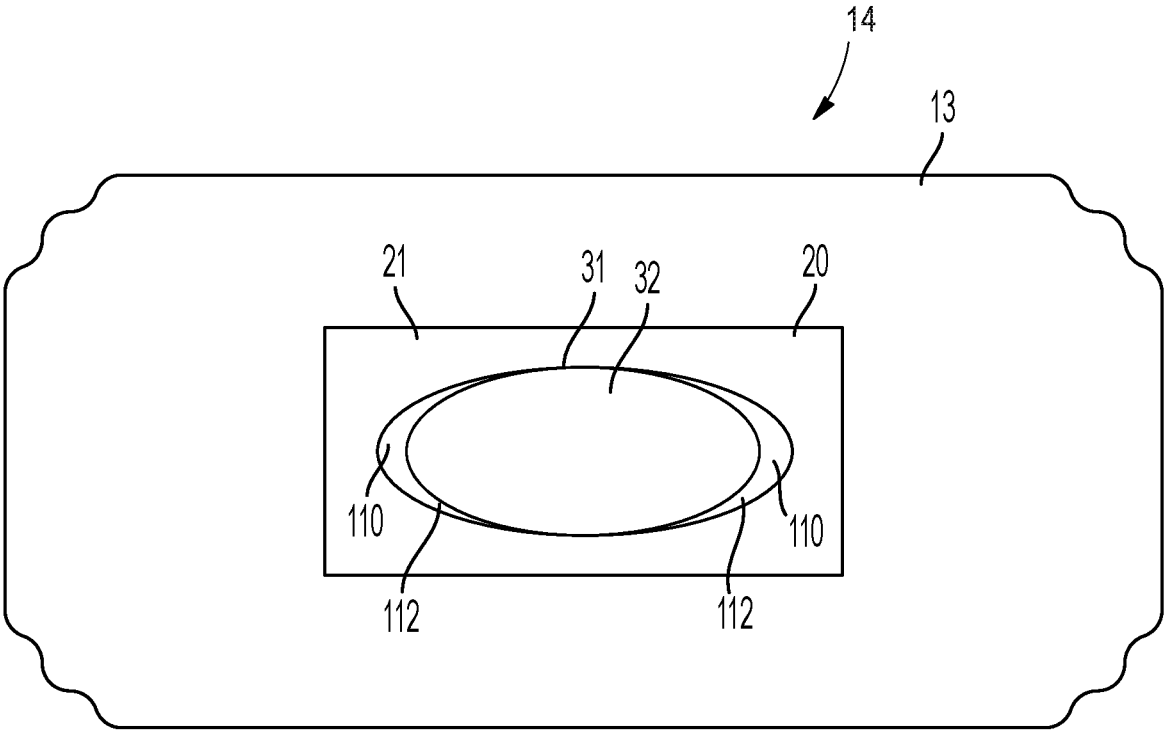
FIG. 12 is a plan view of a portion of a package face with a second semi-permeable membrane of a second pouch of a preservative generation system in a second, open configuration.

Referring to FIGS. 10, 11 and 12, the preservative generation system of the present disclosure may comprise a second pouch 110 disposed in the interior package space 102. Like the first pouch 90, the second pouch 110 may define a closed receptacle around a second reactant 104. The second pouch 110 may comprise a second semi-permeable material 112. The second semi-permeable material 112 may be designed and/or configured to allow entry of water and/or water vapor into the second pouch 110. The second semi-permeable material 112 may be designed and/or configured to allow egress of a preservative, for example a preservative gas. The second semi-permeable material 112 may comprise or be formed of perforated films, non-perforated films, and/or selective transmission films, and combinations thereof.

The second semi-permeable material 112 of the second pouch 110 may be configured to be shielded from contact with water, water vapor, and/or the liquid phase second product element when the outer package 14 is in a first, unopened configuration-meaning post-manufacture but pre-consumer use, for example as shown in FIG. 11 with an opening feature flexible film 31 in place over the package access opening 32. When the outer package 14 is in a second, opened configuration, the second semi-permeable material 112 of the second pouch 110 may be configured to be in contact with water, water vapor, and/or the liquid phase second product element, as shown in FIG. 12 where the opening feature flexible film 31 has been removed exposing both the package access opening 32 and at least a portion of the second pouch 110.

Referring to FIGS. 11 and 12, the second pouch 110 may be disposed around at least a portion of the package access opening 32 such that at least a portion of the second semi-permeable material 112 may be free from attachment to the packaging material 13. When the outer package is in the first, unopened configuration at least a portion of the second semi-permeable material 112 may be joined to the opening feature flexible film 31. The portion of the second semi-permeable material 112 that is free from attachment to the packaging material 13 may be the portion attached to the opening feature flexible film 31, such that no portion of the second semi-permeable material 112 is exposed to the second product element, such as a lotion. Thus, the second semi-permeable material 112 is shielded from exposure to water and/or water vapor-such as that from the second product element. Such a configuration may prevent generation of a preservative from the second pouch while the package is in a sealed configuration.

The first pouch 90 and/or the second pouch 110 may be sealed, such as at pouch seams 94, in order that the reactant 92, 104 remains within the interior space of the respective pouch and is substantially or completely prevented from entering into the interior package space.

In a form, the first pouch 90 and/or the second pouch 110 may be formed by a portion of the packaging material forming a first side of the pouch, and a semi-permeable material forming a portion of a second side of the pouch. Reactant may be disposed within an interior space between the first side and second side. The reactant may be printed, slot-coated, or otherwise deposited on the packaging material before the semi-permeable material is joined to the packaging material to form the first and/or second pouch.

Combinations I

1. A packaged consumer product comprising:
   - a first product element, wherein the first product element is a solid-phase material;
   - a second product element, wherein the second product element is a liquid-phase material;
   - a packaging material defining an interior package space, wherein the first product element and the second product element are disposed within the interior package space; and
   - a first pouch disposed in the interior package space, wherein the first pouch comprises:
     - a first semi-permeable material; and a reactant disposed within an interior of the first pouch, wherein the reactant is configured to generate chlorine dioxide upon exposure to water and/or water vapor.

2. The packaged consumer product of paragraph 1, wherein the first product element comprises less than 1000 μg/ml chlorate/chlorite.
3. The packaged consumer product of any of the preceding paragraphs, wherein the second product element comprises less than 1000 μg/ml chlorate/chlorite.
4. The packaged consumer product of any of the preceding paragraphs, wherein the interior package space comprises a gaseous phase, and wherein the gaseous phase comprises between about 0.25 ppm and about 5 ppm chlorine dioxide when the packaged consumer product is in a sealed configuration.
5. The packaged consumer product of any of the preceding paragraphs, wherein the first semi-permeable material is a water vapor selective membrane.
6. The packaged consumer product of any of the preceding paragraphs, wherein the first product element comprises a nonwoven web of material.
7. The packaged consumer product of any of the preceding paragraphs, wherein the first product element comprises a nonwoven web of material comprising cellulose fiber, lyocell fiber, wood pulp fiber, or combinations thereof.
8. The packaged consumer product of any of the preceding paragraphs, wherein the first product element comprises a hydroentangled nonwoven web.
9. The packaged consumer product of any of the preceding paragraphs, wherein the first product element comprises a co-formed web of wood fiber and polyolefin melt-blown fiber.
10. The packaged consumer product of any of the preceding paragraphs, wherein the first product element comprises a woven or knit web of material.
11. The packaged consumer product of any of the preceding paragraphs, wherein the first product element is disposed in a stack of a plurality of folded webs of material.
12. The packaged consumer product of any of the preceding paragraphs, wherein the second product element is free of benzoic acid and/or a salt thereof.
13. The packaged consumer product of any of the preceding paragraphs, wherein the second product element is free of a chemical preservative.
14. The packaged consumer product of any of the preceding paragraphs, wherein the second product element is present at an amount of between about 1.0 g and about 8.0 g per gram of the first product element.
15. The packaged consumer product of any of the preceding paragraphs, wherein the second product element comprises water.
16. The packaged consumer product of any of the preceding paragraphs, wherein the reactant comprises one of: sodium chlorite, potassium chlorite, citric acid, and combinations thereof.
17. The packaged consumer product of any of the preceding paragraphs, wherein the first pouch has a first side joined to the packaging material and a second side opposite the first side, wherein the second side is formed at least partially from the semi-permeable material.
18. The packaged consumer product of any of the preceding paragraphs, wherein the first pouch is sealed such that the reactant is disposed only in the interior of the first pouch; wherein the first pouch is configured to allow the ingress of water vapor; and wherein the first pouch is further configured to allow the egress of chlorine dioxide gas.
19. A packaged consumer product comprising:
a packaging material defining an interior package space and fully enclosing:
a first product element, wherein the first product element is a solid-phase material;
a second product element, wherein the second product element is a liquid-phase material; and
a first pouch defining an interior pouch space, wherein the first pouch comprises:
a first semi-permeable material; and
a reactant disposed within the interior pouch space, wherein the reactant is configured to generate chlorine dioxide upon exposure to water and/or water vapor;
wherein the package further comprises an opening feature defined within the packaging material and
a closure feature, wherein the closure feature is configured to be reclosable.
20. The packaged consumer product of paragraph 19, wherein the opening feature comprises a series of perforations and/or scoring disposed in the packaging material.
21. The packaged consumer product of paragraphs 19 or 20, wherein the closure feature comprises:
a base joined to the packaging material and disposed around the opening feature; and
a lid, wherein the lid is movable from a first position in which the lid is configured to engage with the base to a second position in which at least one side of the lid is disposed away from the base, exposing the opening feature.
22. The packaged consumer product of any of paragraphs 19-21, wherein the first product element comprises less than 1000 μg/ml chlorate/chlorite.
23. The packaged consumer product of any of paragraphs 19-22, wherein the second product element comprises less than 1000 μg/ml chlorate/chlorite/chlorine.
24. The packaged consumer product of any of paragraphs 19-23, wherein the interior package space comprises a gaseous phase, and wherein the gaseous phase comprises between about 0.25 ppm and about 5 ppm chlorine dioxide when the packaged consumer product is in a sealed configuration.
25. The packaged consumer product of any of paragraphs 19-24, wherein the first semi-permeable material is a water vapor selective membrane.
26. The packaged consumer product of any of paragraphs 19-25, wherein the first product element comprises a nonwoven web of material.
27. The packaged consumer product of any of paragraphs 19-26, wherein the first product element comprises a nonwoven web of material comprising cellulose fiber, lyocell fiber, wood pulp fiber, or combinations thereof.
28. The packaged consumer product of any of paragraphs 19-27, wherein the first product element comprises a hydroentangled nonwoven web.
29. The packaged consumer product of any of paragraphs 19-28, wherein the first product element comprises a co-formed web of wood fiber and polyolefin melt-blown fiber.
30. The packaged consumer product of any of paragraphs 19-29, wherein the first product element comprises a woven or knit web of material.

31. The packaged consumer product of any of paragraphs 19-30, wherein the first product element is disposed in a stack of a plurality of folded webs of material.
32. The packaged consumer product of any of paragraphs 19-31, wherein the second product element is free of benzoic acid and/or a salt thereof.
33. The packaged consumer product of any of paragraphs 19-32, wherein the second product element is free of a chemical preservative.
34. The packaged consumer product of any of paragraphs 19-33, wherein the second product element is present at an amount of between about 1.0 g and about 8.0 g per gram of the first product element.
35. The packaged consumer product of any of paragraphs 19-34, wherein the first pouch has a first side joined to the packaging material and a second side opposite the first side, wherein the second side is formed at least partially from the semi-permeable material.
36. The packaged consumer product of any of paragraphs 19-35, wherein the first pouch is sealed such that the water-soluble reactant is disposed only in the interior of the first pouch; wherein the first pouch is configured to allow the ingress of water vapor; and wherein the first pouch is further configured to allow the egress of chlorine dioxide gas.
37. The packaged consumer product of any of the preceding paragraphs, wherein the first pouch has a top-to-bottom (z-direction) thickness of less than 5 mm, less than 4 mm, less than 3 mm, less than 2 mm, less than 1 mm, or less than 0.5 mm.
38. The packaged consumer product of any of the preceding paragraphs, wherein the first pouch has a top-to-bottom (z-direction) thickness of less than 5 mm, less than 4 mm, less than 3 mm, less than 2 mm, less than 1 mm, or less than 0.5 mm and greater than a thickness of 0.1 mm.
39. The packaged consumer product of any of the preceding paragraphs, wherein the first pouch has a mass of less than 10 g, less than 8 g, less than 6 g, less than 4 g, less than 2 g, less than 0.5 g and greater than 0.01 g.
40. A packaged consumer product comprising:
    a packaging material forming an outer pouch and defining an interior package space;
    a first product element disposed in the interior package space, wherein the first product element is a solid-phase material;
    a second product element disposed in the interior package space, wherein the second product element is a liquid-phase material; and
    a first inner pouch disposed in the interior package space, wherein the first inner pouch comprises:
        a first semi-permeable material; and
        a reactant disposed within an interior of the first pouch, wherein the reactant is configured to generate chlorine dioxide upon exposure to water and/or water vapor.
41. A packaged consumer product comprising:
    a first product element, wherein the first product element is a solid-phase material;
    a second product element, wherein the second product element is a liquid-phase material;
    a packaging material defining an interior package space, wherein the first product element and the second product element are disposed within the interior package space; and
    an interior reactant space disposed within the interior package space and defined on a first side by a portion of the packaging material and defined on a second, opposite side by a first semi-permeable material; and
    a reactant disposed within the interior reactant space, wherein the reactant is configured to generate chlorine dioxide upon exposure to water and/or water vapor.
42. The packaged consumer product of paragraphs 40 or 41, wherein the first product element comprises less than 1000 μg/ml chlorate/chlorite.
43. The packaged consumer product of any of paragraphs 40-42, wherein the second product element comprises less than 1000 μg/ml chlorate/chlorite.
44. The packaged consumer product of any of paragraphs 40-43, wherein the interior package space comprises a gaseous phase, and wherein the gaseous phase comprises between about 0.25 ppm and about 5 ppm chlorine dioxide when the packaged consumer product is in a sealed configuration.
45. The packaged consumer product of any of the preceding paragraphs, wherein the second product element has a Bacterial Log Reduction Factor of greater than or equal to 3 at day 28, according to the Microbiological Susceptibility Test Method.
46. The packaged consumer product of any of the preceding paragraphs, wherein the second product element has a Yeast and Mold Log Reduction Factor of greater than or equal to 2 at day 28, according to the Microbiological Susceptibility Test Method.
47. The packaged consumer product of any of the preceding paragraphs, wherein the packaged consumer product is a wet wipes product.
48. The packaged consumer product of any of the preceding paragraphs, wherein the packaged consumer product is a baby wet wipe product.
49. The packaged consumer product of any of the preceding paragraphs, wherein the packaged consumer product is a flushable wet wipe product.
50. The packaged consumer product of any of the preceding paragraphs, wherein the second product element exhibits low sting potential.

Combinations II

1. A package of wet wipes comprising:
    a nonwoven substrate;
    a lotion;
    an outer package comprising a flexible film defining an interior package space and forming a periphery around the substrate and lotion;
    a first pouch disposed in the interior package space and comprising a first semi-permeable material and a first reactant disposed within the first pouch, wherein the first reactant generates chlorine dioxide upon exposure to water and/or water vapor; and
    a second pouch disposed in the interior package space and comprising a second semi-permeable material and second reactant disposed within the second pouch, wherein the second reactant generates chlorine dioxide upon exposure to water and/or water vapor.
2. The package of wet wipes of paragraph 1, wherein, when the outer package is in a first, unopened configuration, the first semi-permeable material is configured to be in contact with the interior package space, the second semi-permeable material is configured to be shielded from contact with the interior package space, and the outer package completely encloses the substrate and the lotion.

3. The package of wet wipes of any of the preceding paragraphs, wherein, when the outer package is in a second, opened configuration, the second semi-permeable material is configured to be in contact with the interior package space, and wherein the outer package defines an opening.
4. The package of wet wipes of any of the preceding paragraphs, wherein the outer package comprises an opening feature configured to be opened by a user.
5. The package of wet wipes of paragraph 4, wherein the opening feature comprises an opening feature flexible film, wherein the opening feature flexible film is fully removable from the package of wet wipes.
6. The package of wet wipes of paragraphs 4 or 5, wherein the opening feature comprises a rigid fitment.
7. The package of wet wipes of any of paragraphs 4-6, wherein at least a portion of the second semi-permeable material is joined to the opening feature when the outer package is in the first, unopened configuration.
8. The package of wet wipes of any of paragraphs 4-6, wherein the second pouch initiates generation of chlorine dioxide upon exposure to water and/or water vapor after the outer package is in a second, open configuration.
9. The package of wet wipes of any of the preceding paragraphs, wherein the nonwoven substrate comprises less than 1000 μg/ml chlorate/chlorite.
10. The package of wet wipes of any of the preceding paragraphs, wherein the lotion comprises less than 1000 μg/ml chlorate/chlorite.
11. The package of wet wipes of any of the preceding paragraphs, wherein the interior package space comprises a gaseous phase, and wherein the gaseous phase comprises between about 0.25 ppm and about 5 ppm chlorine dioxide when the packaged consumer product is in an unopened and sealed configuration.
12. The package of wet wipes of any of the preceding paragraphs, wherein the first semi-permeable material and/or the second semi-permeable material is a water vapor selective membrane.
13. The package of wet wipes of any of the preceding paragraphs, wherein the nonwoven substrate comprises cellulose fiber, lyocell fiber, wood pulp fiber, or combinations thereof.
14. The package of wet wipes of any of the preceding paragraphs, wherein the nonwoven substrate comprises a hydroentangled nonwoven web.
15. The package of wet wipes of any of the preceding paragraphs, wherein the nonwoven substrate comprises a co-formed web of wood fiber and polyolefin meltblown fiber.
16. The package of wet wipes of any of the preceding paragraphs, wherein nonwoven substrate is disposed in a stack of a plurality of folded webs of material.
17. T The package of wet wipes of any of the preceding paragraphs, wherein the lotion is free of benzoic acid and/or a salt thereof.
18. The package of wet wipes of any of the preceding paragraphs, wherein the lotion is free of a chemical preservative.
19. The package of wet wipes of any of the preceding paragraphs, wherein the lotion is present at an amount of between about 1.0 g and about 8.0 g per gram of the nonwoven substrate.
20. The package of wet wipes of any of the preceding paragraphs, wherein the lotion comprises water.
21. The package of wet wipes of any of the preceding paragraphs, wherein the reactant comprises one of: sodium chlorite, potassium chlorite, citric acid, and combinations thereof.
22. The package of wet wipes of any of the preceding paragraphs, wherein the first pouch generates chlorine dioxide upon the packaging material first forming the periphery around the substrate and lotion and being sealed to form the outer package.
23. The package of wet wipes of any of the preceding paragraphs, wherein the first pouch and/or the second pouch has a top-to-bottom (z-direction) thickness of less than 5 mm, less than 4 mm, less than 3 mm, less than 2 mm, less than 1 mm, or less than 0.5 mm.
24. The package of wet wipes of any of the preceding paragraphs, wherein the first pouch and/or the second pouch has a top-to-bottom (z-direction) thickness of less than 5 mm, less than 4 mm, less than 3 mm, less than 2 mm, less than 1 mm, or less than 0.5 mm and greater than a thickness of 0.1 mm.
25. The package of wet wipes of any of the preceding paragraphs, wherein the first pouch has a mass of less than 10 g, less than 8 g, less than 6 g, less than 4 g, less than 2 g, less than 0.5 g and greater than 0.01 g.
26. A package of wet wipes comprising:
    a nonwoven substrate;
    a lotion;
        an outer package comprising a flexible film defining an interior package space and forming a periphery around the substrate and lotion;
    a first interior reactant space disposed within the interior package space and defined on a first side by a portion of the flexible film and defined on a second, opposite side by a first semi-permeable material;
    a first reactant disposed within the first interior reactant space, wherein the first reactant is configured to generate chlorine dioxide upon exposure to water and/or water vapor;
    a second interior reactant space disposed within the interior package space and defined on a first side a second semi-permeable material; and
    a second reactant disposed within the second interior reactant space, wherein the second reactant is configured to generate chlorine dioxide upon exposure to water and/or water vapor.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this present disclosure.

What is claimed is:

1. A packaged consumer product comprising:

a first product element, wherein the first product element is a solid-phase material;

a second product element, wherein the second product element is a liquid-phase material;

a packaging material defining an interior package space, wherein the first product element and the second product element are disposed within the interior package space; and a first pouch disposed in the interior package space, wherein the first pouch comprises:

a first semi-permeable material; and a reactant disposed within an interior of the first pouch, wherein the reactant is configured to generate chlorine dioxide upon exposure to water and/or water vapor;

wherein the first product element comprises less than 1000 μg/ml chlorate/chlorite.

2. The packaged consumer product of claim 1, wherein the second product element comprises less than 1000 μg/ml chlorate/chlorite.

3. The packaged consumer product of claim 1, wherein the interior package space comprises a gaseous phase, and wherein the gaseous phase comprises between about 0.25 ppm and about 5 ppm chlorine dioxide when the packaged consumer product is in a sealed configuration.

4. The packaged consumer product of claim 1, wherein the first semi-permeable material is a water vapor selective membrane.

5. The packaged consumer product of claim 1, wherein the first product element comprises a nonwoven web of material.

6. The packaged consumer product of claim 1, wherein the first product element comprises a nonwoven web of material comprising cellulose fiber, lyocell fiber, wood pulp fiber, or combinations thereof.

7. The packaged consumer product of claim 1, wherein the first product element comprises a hydroentangled nonwoven web.

8. The packaged consumer product of claim 1, wherein the first product element comprises a co-formed web of wood fiber and polyolefin melt-blown fiber.

9. The packaged consumer product of claim 1, wherein the first product element comprises a woven or knit web of material.

10. The packaged consumer product of claim 1, wherein the first product element is disposed in a stack of a plurality of folded webs of material.

11. The packaged consumer product of claim 1, wherein the second product element is free of benzoic acid and/or a salt thereof.

12. The packaged consumer product of claim 1, wherein the second product element is free of chemical preservatives.

13. The packaged consumer product of claim 1, wherein the second product element is present at an amount of between about 1.0 g and about 8.0 g per gram of the first product element.

14. The packaged consumer product of claim 1, wherein the second product element comprises water.

15. The packaged consumer product of claim 1, wherein the reactant comprises one of: sodium chlorite, potassium chlorite, citric acid, and combinations thereof.

16. The packaged consumer product of claim 1, wherein the first pouch has a first side joined to the packaging material and a second side opposite the first side, wherein the second side is formed at least partially from the semi-permeable material.

17. The packaged consumer product of claim 1, wherein the first pouch is sealed such that the reactant is disposed only in the interior of the first pouch; wherein the first pouch is configured to allow the ingress of water vapor; and wherein the first pouch is further configured to allow the egress of chlorine dioxide gas.

18. The packaged consumer product of claim 1, wherein the first pouch is configured to retain the reactant and prevent entry of the reactant into the interior package space.

19. A packaged consumer product comprising:

a nonwoven substrate;

a lotion;

an outer package comprising a flexible film defining an interior package space and forming a periphery around the substrate and lotion;

a first pouch disposed in the interior package space and comprising a first semi-permeable material and a first reactant disposed within the first pouch, wherein the first reactant generates chlorine dioxide upon exposure to water and/or water vapor; and a second pouch disposed in the interior package space and comprising a second semi-permeable material and second reactant disposed within the second pouch, wherein the second reactant generates chlorine dioxide upon exposure to water and/or water vapor.

20. A packaged consumer product comprising:

a first product element, wherein the first product element is a solid-phase material;

a second product element, wherein the second product element is a liquid-phase material;

a packaging material defining an interior package space, wherein the first product element and the second product element are disposed within the interior package space; and a first pouch disposed in the interior package space, wherein the first pouch comprises:

a first semi-permeable material; and a reactant disposed within an interior of the first pouch, wherein the reactant is configured to generate chlorine dioxide upon exposure to water and/or water vapor;

wherein the interior package space comprises a gaseous phase, and wherein the gaseous phase comprises between about 0.25 ppm and about 5 ppm chlorine dioxide when the packaged consumer product is in a sealed configuration.

* * * * *